US006149284A

United States Patent [19]

Wang

[11] Patent Number: 6,149,284

[45] Date of Patent: Nov. 21, 2000

[54] NET TYPE ARRANGEMENT STRUCTURE OF MINIATURE LIGHT BULB SERIES

[76] Inventor: Jung Kuei Wang, No. 2, Lane 60, Kuang Hua 1st Street, Hsinchu, Taiwan

[21] Appl. No.: 09/259,314

[22] Filed: Mar. 1, 1999

[51] Int. Cl.[7] ..... F21V 21/00

[52] U.S. Cl. ..... 362/249; 362/123; 362/806

[58] Field of Search ..... 362/249, 252, 362/123, 806, 227

[56] References Cited

U.S. PATENT DOCUMENTS 5,601,361 2/1997 Lawerence ..... 362/123
5,934,793 8/1999 Rahman ..... 362/249
5,944,408 8/1999 Tong et al. ..... 362/252

*Primary Examiner*—Thomas M. Sember
*Attorney, Agent, or Firm*—Rosenberg, Klein & Lee

[57] ABSTRACT

The present invention relates to a net type light bulb array that consists of a special arrangement of linear light bulb series combined by connection wires to form a planar structure of net type light bulb arrays. The invention has the advantages of a high binding strength and stable construction. The light bulb array according to the invention is especially suitable for use in decorative purposes. In addition, it can combine a plurality of light bulb series to form a larger area of light bulb arrays. The invention enhances the practical value of light bulb arrays considerably.

1 Claim, 4 Drawing Sheets

NET TYPE ARRANGEMENT STRUCTURE OF MINIATURE LIGHT BULB SERIES

BACKGROUND OF THE INVENTION

The interconnection between miniature light bulb series to form a miniature light bulb array has been widely adopted. Such a net type arrangement of miniature light bulbs provides a planar visual entertainment and a better decorative effect. In conventional structures of net type miniature light bulb array, most of them use interconnection between electrical wires in cooperation with fastening means of light bulb sockets to combine a plurality of light bulbs, forming a planar net type array of light bulbs. Such structures are inconvenient and tedious in assemblage. Interconnection between electrical wires often brings poor contact problems, not to mention the difficulties in packing and storage. Tangled electrical wires may result in malfunction of miniature light bulbs. Besides, needing extra fastening means of a light bulb socket also leads to increase in manufacturing cost and annoyance in assemblage. Thus it is desirable to have an improvement made on the above conventional structures.

In view of the above problems, the object of the invention is to provide a net type miniature light bulb array structure that uses connection wires to directly combine linear type light bulb series to form a firm light bulb net in an easy way. Thus the structure according to the invention can overcome the deficiencies of conventional light bulb arrays. Now the structure and features of the invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
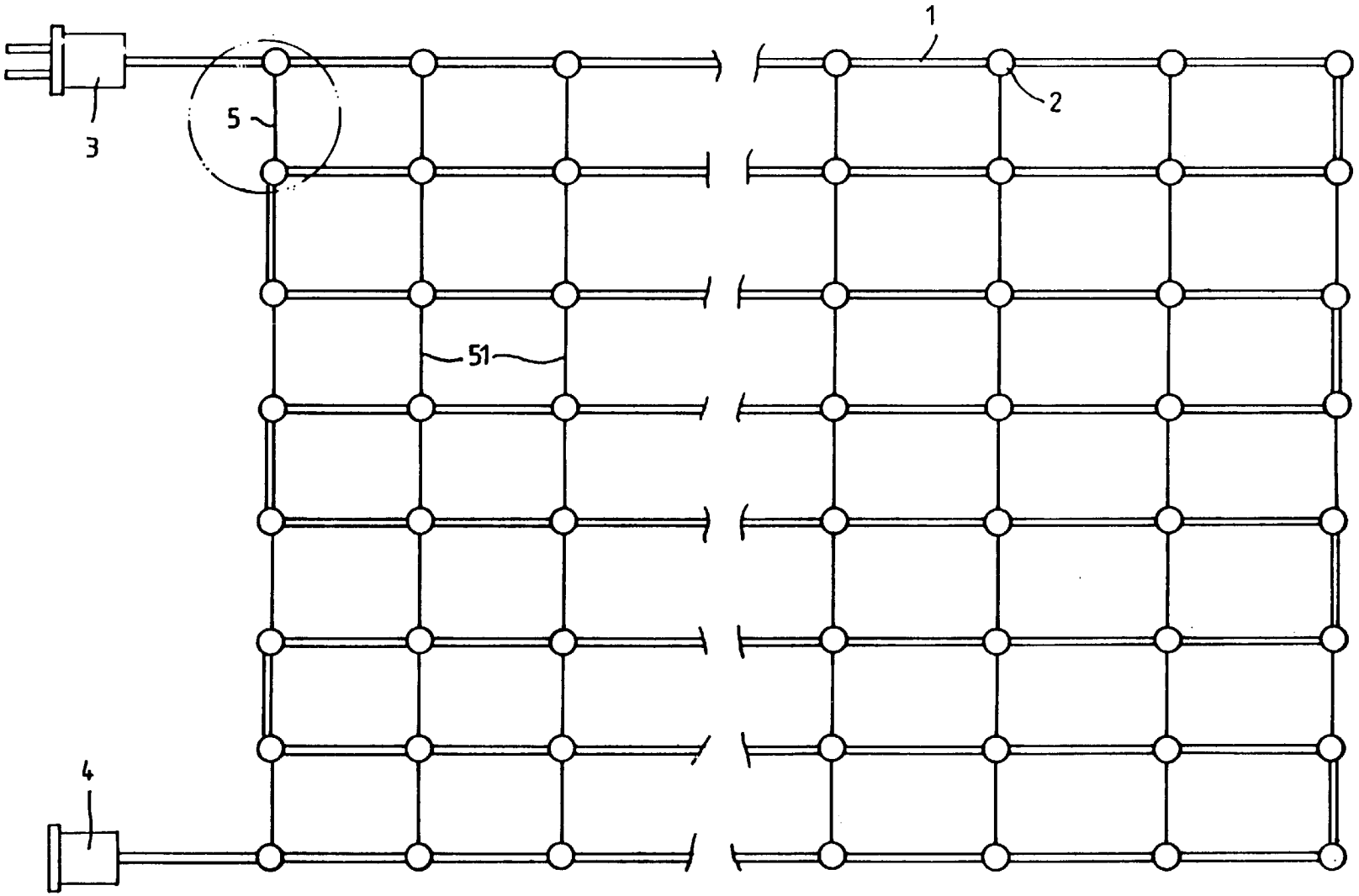
FIG. 1 is a plan view showing a net type array arrangement of miniature light bulbs according to the invention.
Figure 2:
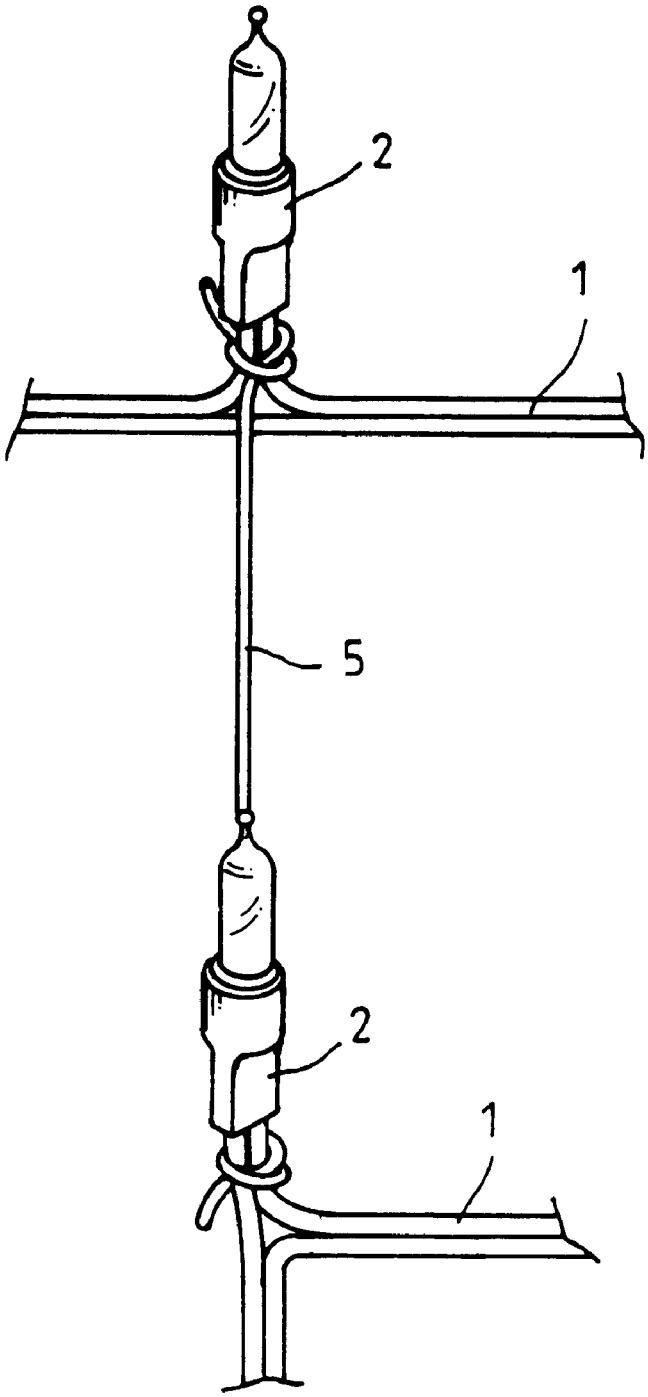
FIG. 2 is a perspective view partially showing the structure of the net type light bulb array of FIG. 1.
Figure 3:
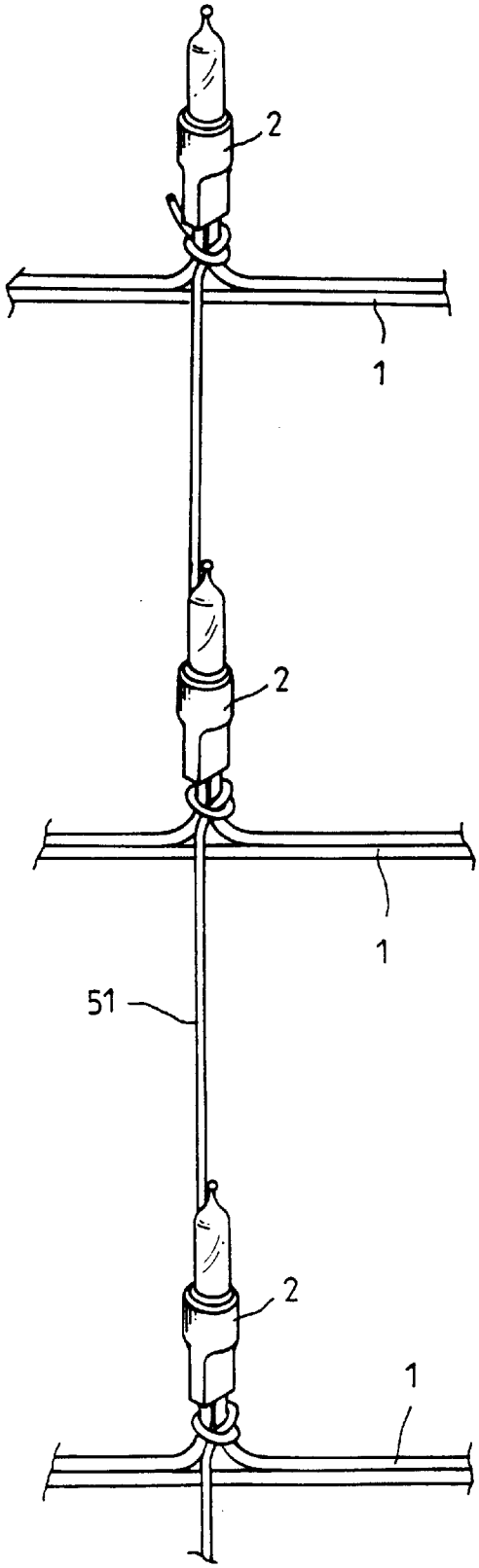
FIG. 3 is another perspective view partially indicating the structure of the net type light bulb array of FIG. 1.

Referring to FIG. 1, the net type light bulb array of the invention is composed of linear type light bulb series, which consist of an electrical wire (1) combining a plurality of miniature light bulb sets (2). The electrical wire (1) is provided with an electrical plug (3) on one end and an electrical socket (4) on the other end. The electrical wire (1) is first arranged in a consecutive winding curve as shown in FIG. 1 to form a plurality of parallel rows. Thus the miniature light bulb sets (2) of a light bulb series can be aligned in horizontal rows and vertical columns. In the horizontal direction, light bulb sets (2) are interconnected with the electrical wire (1) while they are combined with each other by a connection wire (5) in the vertical direction. As can be seen from FIG. 2, the connection wire (5) is respectively tied on two ends to the electrical wires of the first light bulb sets of the first row and the second row, which are located under the light bulb sockets. As shown in FIG. 3, a longer connection wire (51) combines the second light bulb set of the first row with the second light bulb sets of the other rows in sequence in a way of tieing the wire (51) to the electrical wires under light bulb sockets and finally tieing the rear end of the connection wire (51) to the electrical wire under the second light bulb set of the lowest row. With this arrangement, the linear type light bulb series can form a firm net type light bulb array by means of connection wires (5) and (51). Such a light bulb array has a high binding strength in the vertical direction as well as in the horizontal direction. It provides the advantage of not-ease-to-loosen.

Because that the present invention uses average linear type light bulb series, it needs to change neither the structure of light bulb sockets nor the connection method of electrical wires of light bulb series. In addition, the present invention employs a combination of linear arrangement of light bulb series with the connection wires to form a practical net type light bulb array. Thus it provides the advantage of ease-to-assembly and avoids tangled wires occurred by protrusive securing means of light bulb sockets. Obviously the invention can enhance the practical value of light bulb series.

Figure 4:
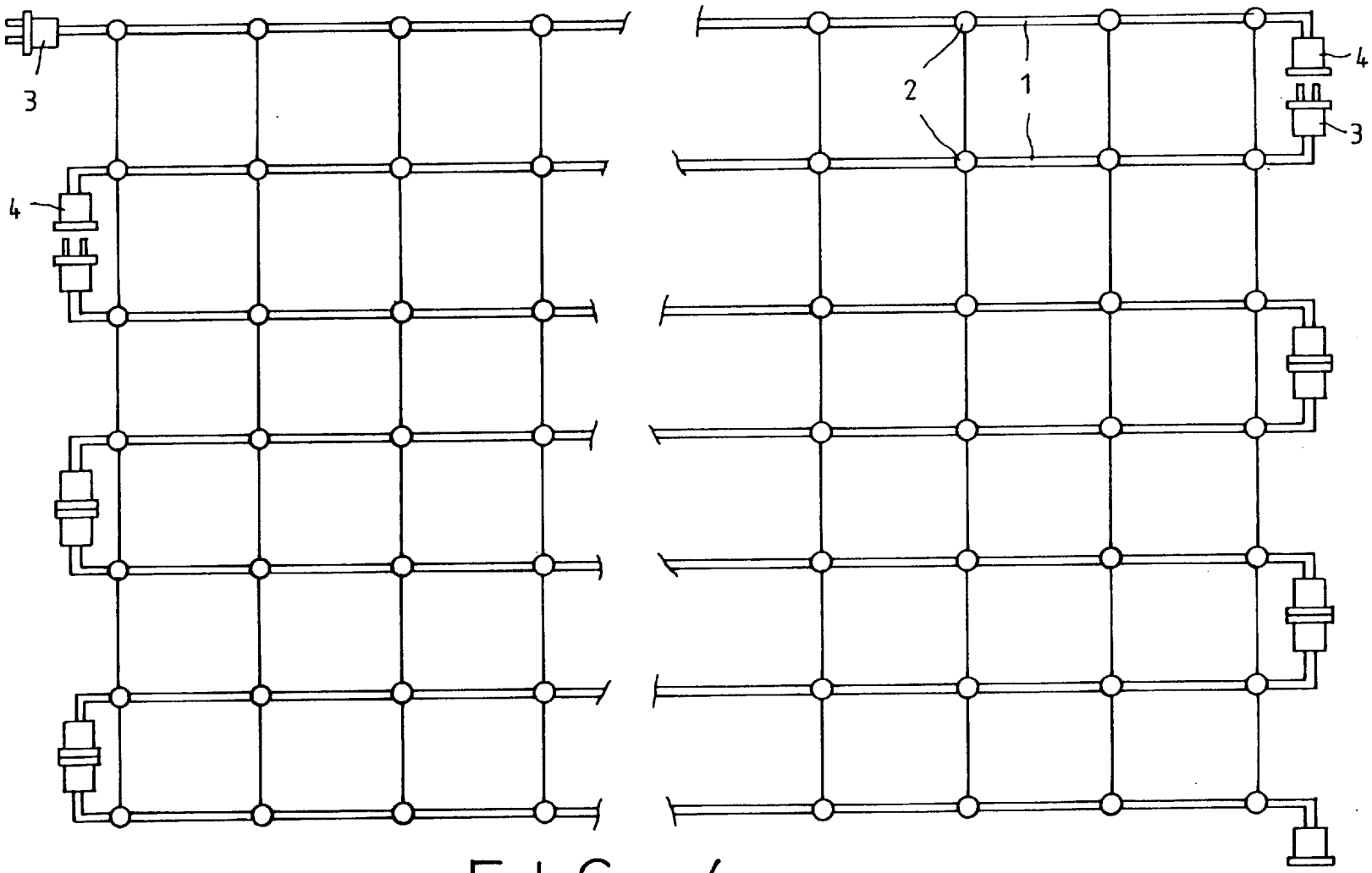
FIG. 4 shows a combined arrangement of a plurality of net type miniature light bulb arrays according to the invention.

As shown in FIG. 4, the present invention can connect in sequence a plurality of the above light bulb arrays by attaching the electrical plug of the next light bulb series to the electrical socket of the previous bulb series one by one to form a larger light bulb array. Thus large area of net type light bulb array can be formed in an easy way according to the invention. Thus the invention has higher practical value in the industry. Obviously the invention meets the requirements of granting a patent. Therefore we hereby apply for a patent.

What is claimed is:

1. A net type lighting array, comprising:

at least one decorative lighting string, said lighting string having a plug, a plurality of electrical wires extending from said plug, and a plurality light assemblies electrically connected to at least a potion of said plurality of electrical wires in longitudinally spaced relationship, said lighting string being formed in a serpentine pattern having alternating opposed open ends with a plurality of parallel longitudinal rows, wherein a respective portion of said plurality of light assemblies of each said row are respectively aligned with corresponding light assemblies of other of said rows to form transverse columns of light assembles and thereby define a two-dimensional lighting array;

a plurality of non-electricity carrying first connection wires, each of said first connection wires having a first predetermined length, each of said first connection wires extending between a respective one of said open ends of said serpentine pattern and having each of two opposing ends thereof tied to at least one of said plurality of electrical wires adjacent a corresponding one of said plurality of light assemblies; and, a plurality of non-electricity carrying second connection wires, each of said second connection wires having a second predetermined length, said second predetermined length being greater than said first predetermined length, each of said second connection wires extending between each respective lamp assembly of a non-endmost one of said columns of lamp assemblies and being tied to at least one of said plurality of electrical wires adjacent each said light assembly.

* * * * *